United States Patent [19]

Cunningham et al.

[11] 4,304,365

[45] Dec. 8, 1981

[54] ELECTROSTATIC YARN PICK-UP

[75] Inventors: McCleery B. Cunningham; Manson D. Case, both of Hartsville, S.C.

[73] Assignee: Sonoco Products Company, Hartsville, S.C.

[21] Appl. No.: 232,016

[22] Filed: Feb. 6, 1981

[51] Int. Cl.[3] ..... B65H 65/00; B65H 75/28

[52] U.S. Cl. ..... 242/18 PW; 242/74; 242/125.1

[58] Field of Search ..... 242/18 PW, 18 R, 18 A, 242/18 G, 125, 125.1, 74, 54.4; 226/94

[56] References Cited

U.S. PATENT DOCUMENTS

| | | | |
|---|---|---|---|
| 2,895,511 | 7/1959 | Seltman | 242/74 X |
| 3,030,045 | 4/1962 | Rehklau | 242/74 |
| 3,326,494 | 6/1967 | Hartley, Jr. | 242/125.1 |
| 3,451,639 | 6/1969 | Atwood et al. | 242/125.1 X |
| 3,625,451 | 12/1971 | Anderson | 242/125.1 |
| 3,717,291 | 2/1973 | Adams et al. | 242/125.1 X |

*Primary Examiner*—Stanley N. Gilreath

*Attorney, Agent, or Firm*—Dennison, Meserole, Pollack & Scheiner

[57] ABSTRACT

A system and method of providing electrostatic pick-up of yarn on a rotating carrier tube or the like involving provision and use of an electrostatic generator for the application of a static charge to the leading section of the yarn which is subsequently directed across a spindle mounted rotating carrier in a manner whereby the yarn is adhered to or picked up on the tube by electrostatic attraction, the continuous high speed rotation of the carrier effecting a quick positive achievement of multiple wraps of yarn about the carrier.

4 Claims, 2 Drawing Figures

ELECTROSTATIC YARN PICK-UP

BACKGROUND OF THE INVENTION

The invention herein broadly involves yarn carriers, normally tubes, cones, and the like. More particularly, the invention is concerned with yarn pick-up, that is the procedure whereby feeding yarn is directed to and engaged by a carrier or winding tube rotating at high speed for attachment and retention of the yarn to initiate wrapping of the yarn about the carrier.

Many proposals have been put forth for engaging the leading or free end of yarn, some of which require a stationary carrier, and others of which provide for engagement of running yarn with a rotating carrier. For example, it has been known to anchor the free end of the yarn with small bits of glue, adhesive tape, mechanical tabs, clips, and the like. However, the most effective means to date for the securement of running yarn has been the use of pick-up or string-up grooves cut into the periphery of the carrier tubes, normally adjacent one end thereof. Some examples of such pick-up grooves will be noted in the following U.S. Pat. Nos.:

Hartley, Jr.: 3,326,494
Atwood et al: 3,451,639
Anderson: 3,625,451
Adams et al: 3,717,291

Basically, the groove provides a means for rapidly engaging and securing the yarn as the first few wraps are wound about the tube.

While pick-up grooves are substantially universally used, are the subject of a substantial number of patents, and the subject of much research in an effort to improve the performance thereof, such grooves do give rise to basic problems. For example, the presence of the groove within the tube wall, regardless of the configuration thereof, inherently weakens the tube. A further drawback of the use of pick-up grooves is the necessity for providing and maintaining the equipment required to cut the grooves, as well as the labor and time expenditures associated with the additional and relatively exacting steps required to cut the grooves.

Other difficulties inherent in the use of the pick-up grooves include problems associated with a proper engagement of the yarn within the groove, as well as the possibility of difficulties arising in connection with yarn removal from a wedge-locked engagement within the groove.

One attempt to avoid the use of tube grooves has involved, in the fiberglass industry, initial adherence of the yarn to the carrier by wetting the yarn and relying on frictional engagement of the yarn with the rotating tube. This of course requires the presence of a wetting medium and the disruptive effect of the wet yarn on the carrier or tube, particularly when the carrier is of conventional composite multi-layer paperboard construction.

SUMMARY OF THE INVENTION

The invention herein proposed a yarn pick-up procedure which eliminates the relatively effective but troublesome groove, and similarly avoids any other modification of or physical change in the construction of the carrier tube which might affect the strength, reusability, etc. of the tube.

In addition, the procedure of the present invention, while providing for an effective adherence of the yarn to the tube, does so without adding to the yarn any physically disruptive substance, such as adhesive, a wetting medium, or the like.

The invention herein primarily involves the steps of drawing the yarn from a feed supply through an electrostatic generator and subsequently into contact with, or in closely adjacent proximity to, the surface of a rotating carrier tube or the like. The electrostatic attraction between the yarn and tube attracts the yarn to the tube and effectively holds the yarn on the tube during at least the first few yarn securing wraps about the tube.

Secured in this manner, the yarn pick-up is positive, efficient, involves no line-up problems as with grooves, clips or the like, introduces no problems with regard to the yarn removal from the tube, and, as there is no physical effect on the surface of the tube, enables tube reuse.

DESCRIPTION OF THE PREFERRED EMBODIMENT

Figure 1:
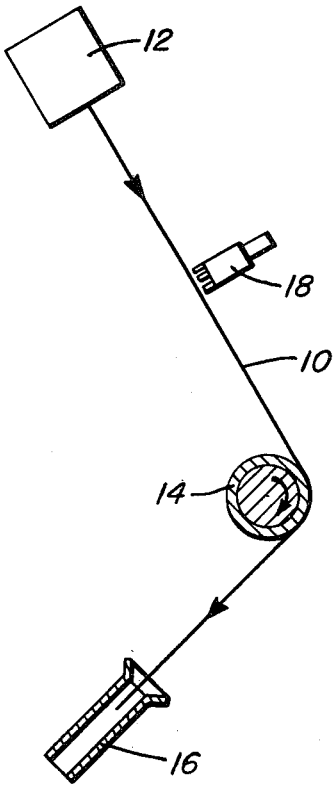
FIG. 1 is a schematic side view illustrating the system and procedure of the present invention.
Figure 2:
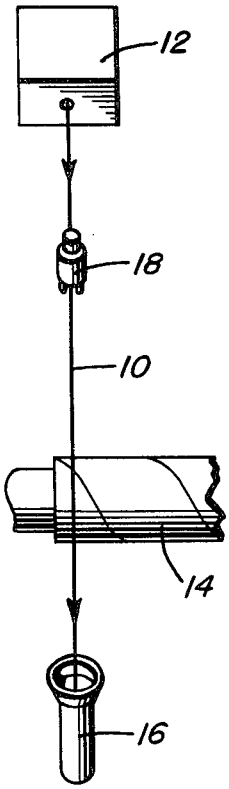
FIG. 2 is a schematic face view illustrating the system and procedure of the present invention.

Referring now more specifically to the drawings, FIGS. 1 and 2 schematically illustrate a typical installation wherein yarn 10, this term being used in its broadest sense to include man-made and natural fibers, is fed from a source 12 to a spindle mounted carrier or carrier tube 14 for engagement therewith and winding thereon in the formation of a yarn package. Basically, this involves bringing the spindle-mounted tube up to rotational speed, which can be as much as 10,000 RPM, after which the yarn 10, the leading portion being received within an appropriate manipulable suction pipe 16 or the like, is brought into yarn securing engagement with the tube 14. This securement, as noted above, has heretofore been most efficiently provided for by grooves defined within the surface of the carrier tube. Upon engagement with the tube, the yarn 10 is broken between the tube and the alignment tool or pipe 16, and the wrap about the tube 14 commences. The procedure as thus described is substantially conventional.

The present invention proposes an improved system and method which utilizes an electrostatic generator 18 interposed between the yarn source or supply 12 and the carrier tube 14 which is to receive the yarn 10. This electrostatic generator will apply or induce a static charge to the yarn 10 immediately upstream of the spindle mounted tube 14. The charge applied will be sufficiently strong to retain the yarn 10 on the tube 14, after the charged yarn is brought into contact therewith or in such close proximity as to be electrostatically attracted and held thereto, and will provide positive retention of the yarn on the tube during at least the initial few yarn-securing wraps thereof about the rotating tube. The engagement of the yarn with the tube will in turn disengage the yarn from the yarn handling suction pipe or the like 16.

One example of appropriate electrostatic generating equipment is the Model N16V Charging Power Unit, 120 volts, 60 Hz, with a multi-point charging bar, manufactured by the Simco Company, Inc. of Lansdale, Pa.

As will be appreciated, the provision of a system which incorporates means for electrostatically charging yarn immediately prior to bringing the yarn in contact with the carrier tube, as well as the particular provision of the method step of electrostatically charging the yarn, is significant in achieving a pick-up procedure which avoids tube modification and the equipment expense, time expending procedures, and the like associated therewith. Further, the problems of groove alignment, yarn snagging within the groove, and yarn release from the groove, are also avoided. An additional advantage achieved is the avoidance of any tendency to weaken or disrupt the tube itself, thereby ensuring the reusability of the tube.

Although not restricted thereto, it is contemplated that the procedure of the present invention be of particular practicability when the yarn receiving tubes are of composite multilayer paperboard construction in that composite tubes, while by far the most commonly used type of tubes, are particularly susceptible to the adverse effects of grooving and the problems of groove and tube dimensional changes due to variations in moisture content in the tubes which can result from humidity in the ambient atmosphere.

The foregoing is considered illustrative of the principles of the invention. Since variations may occur to those skilled in the art, it is to be appreciated that resort may be had to all such variations considered to fall within the scope of the invention as claimed.

We claim:

1. A method of adhering the yarn to and winding yarn on a rotating yarn carrier comprising applying a static charge to the yarn and directing the charged yarn into sufficiently close proximity to surface contact with the rotating carrier to electrostatically adhere the yarn to the carrier during at least the initial wraps of the yarn about the carrier.

2. The method of claim 1 wherein movement of the yarn is continuous from the area of application of the static charge to adhering engagement with the carrier.

3. The method of claim 2 wherein the electrostatic adherence of the yarn to the carrier constitutes the sole means of initial adherence of the yarn to the carrier.

4. A yarn pick-up system comprising a source of infeeding yarn, yarn handling means outward of said source, a carrier mounting spindle interposed between said yarn feeding source and said yarn handling means, and means for generating an electrostatic charge on yarn interposed between said yarn feeding source and said spindle along the path of movement of yarn between the source and spindle.

* * * * *